US009892684B2

(12) United States Patent
Han

(10) Patent No.: US 9,892,684 B2
(45) Date of Patent: Feb. 13, 2018

(54) PIXEL COMPENSATION CIRCUIT AND METHOD

(71) Applicant: Shenzhen China Star Optoelectronics Technology Co., Ltd., Shenzhen, Guangdong (CN)

(72) Inventor: Baixiang Han, Guangdong (CN)

(73) Assignee: Shenzhen China Star Optoelectroniccs Technology Co., Ltd., Shenzhen, Guangdong (CN)

( * ) Notice: Subject to any disclaimer, the term of this patent is extended or adjusted under 35 U.S.C. 154(b) by 162 days.

(21) Appl. No.: 15/021,709

(22) PCT Filed: Feb. 25, 2016

(86) PCT No.: PCT/CN2016/074528
§ 371 (c)(1),
(2) Date: Mar. 14, 2016

(87) PCT Pub. No.: WO2017/128464
PCT Pub. Date: Aug. 3, 2017

(65) Prior Publication Data

US 2017/0330505 A1 Nov. 16, 2017

(30) Foreign Application Priority Data

Jan. 29, 2016 (CN) ..... 2016 1 0067869

(51) Int. Cl.
*G09G 3/325* (2016.01)
*G09G 3/20* (2006.01)
*G09G 3/00* (2006.01)

(52) U.S. Cl.
CPC ..... *G09G 3/325* (2013.01); *G09G 3/007* (2013.01); *G09G 3/2092* (2013.01); *G09G 2320/0233* (2013.01)

(58) Field of Classification Search
CPC ..... G09G 3/3233; G09G 2300/0465; G09G 2300/0819; G09G 2300/0876
See application file for complete search history.

(56) References Cited

U.S. PATENT DOCUMENTS

2007/0146247 A1* 6/2007 Huang ..... G09G 3/3233 345/76
2008/0018568 A1* 1/2008 Chen ..... G09G 3/3233 345/82

(Continued)

FOREIGN PATENT DOCUMENTS

CN 101236724 A 2/2008
CN 201266474 Y 7/2009

(Continued)

*Primary Examiner* — Shaheda Abdin
(74) *Attorney, Agent, or Firm* — Andrew C. Cheng

(57) ABSTRACT

A pixel compensation circuit contains first controllable switch's control terminal is connected to first scan line, and first terminal to data line; driving switch's control terminal is connected to second terminals of first and third controllable switches, and second terminal to OLED's anode and fifth controllable switch's first terminal, cathode to ground; second controllable switch's control terminal is connected to lighting control terminal, and first terminal to a voltage terminal; second scan line is connected to control terminals of third to fifth controllable switches, first terminals of the third and second controllable switches are connected; driving switch's first terminal is connected to second controllable switch's second terminal and fourth controllable switch's first terminal, reference voltage terminal is connected to second terminals of fourth and fifth switches; driving switch's control terminal is connected to its first terminal through storage capacitor.

6 Claims, 4 Drawing Sheets

(56) References Cited

U.S. PATENT DOCUMENTS

| | | | | |
|---|---|---|---|---|
| 2009/0201231 | A1* | 8/2009 | Takahara | G09G 3/3233 345/76 |
| 2009/0262101 | A1 | 10/2009 | Nathan et al. | |
| 2011/0193855 | A1* | 8/2011 | Han | G09G 3/3233 345/214 |
| 2014/0145918 | A1 | 5/2014 | Kwak | |
| 2016/0240136 | A1 | 8/2016 | Han | |
| 2016/0260377 | A1 | 9/2016 | Hu | |

FOREIGN PATENT DOCUMENTS

| | | | |
|---|---|---|---|
| CN | 101916533 | B | 4/2013 |
| CN | 104680978 | A | 6/2015 |
| CN | 103021338 | B | 8/2015 |
| CN | 103871359 | B | 4/2016 |

* cited by examiner

PIXEL COMPENSATION CIRCUIT AND METHOD

BACKGROUND OF THE INVENTION

1. Field of the Invention

The present disclosure generally relates to display technologies, and particularly relates to a pixel compensation circuit and a related method.

2. The Related Arts

Currently Organic Light Emitting Diode (OLED) display devices are gaining widespread attention as they enjoy advantages such as small dimension, simple structure, self-illumination, high brightness, wide viewing angle, and short response time, etc.

Current OLED display devices have a driving transistor controlling the current passing through OLED. The driving transistor usually suffers shift in its threshold voltage due to factors such as the driving transistor's exposure to light, the stress from its source-drain voltage. The threshold voltage's positive or negative shift leads to different amount of current passing through OLED under a same data signal, causing OLED's deterioration and display panel's un-uniform brightness.

SUMMARY OF THE INVENTION

The present disclosure teaches a pixel compensation circuit and a related method that can provide recovery to threshold voltage shift and achieve uniform brightness of a display panel.

The pixel compensation circuit contains the following components:

a first controllable switch having a control terminal connected to a first scan line, a first terminal connected to a data line, and a second terminal;

a driving switch having a control terminal connected to the second terminal of the first controllable switch, a first terminal, and a second terminal;

an Organic Light Emitting Diode (OLED) having an anode connected to the second terminal of the driving switch and a cathode connected to ground;

a second controllable switch having a control terminal connected to a lighting control terminal, a first terminal connected to a voltage terminal, and a second terminal connected to the first terminal of the driving switch;

a third controllable switch having a control terminal connected to a second scan line, a first terminal connected to the first terminal of the second controllable switch, and a second terminal connected to the control terminal of the driving switch;

a fourth controllable switch having a control terminal connected to the second scan line, a first terminal connected to the first terminal of the driving switch, and a second terminal connected to a reference voltage terminal;

a fifth controllable switch having a control terminal connected to the second scan line, a first terminal connected to the second terminal of the driving switch, and a second terminal connected to the reference voltage terminal; and a storage capacitor having a first terminal connected to the control terminal of the driving switch and a second terminal connected to the first terminal of the driving switch.

For the pixel compensation circuit described above, the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

The present disclosure teaches another pixel compensation circuit which contains the following components:

a first controllable switch having a control terminal connected to a first scan line, a first terminal connected to a data line, and a second terminal;

a driving switch having a control terminal connected to the second terminal of the first controllable switch, a first terminal, and a second terminal;

an Organic Light Emitting Diode (OLED) having an anode connected to the second terminal of the driving switch and a cathode connected to ground;

a second controllable switch having a control terminal connected to a lighting control terminal, a first terminal connected to a voltage terminal, and a second terminal connected to the first terminal of the driving switch;

a third controllable switch having a control terminal connected to a second scan line, a first terminal connected to the first terminal of the second controllable switch, and a second terminal connected to the control terminal of the driving switch;

a fourth controllable switch having a control terminal connected to the second scan line, a first terminal connected to the first terminal of the driving switch, and a second terminal connected to a reference voltage terminal;

a fifth controllable switch having a control terminal connected to the second scan line, a first terminal connected to the second terminal of the driving switch, and a second terminal connected to the reference voltage terminal; and a storage capacitor having a first terminal connected to the control terminal of the driving switch and a second terminal connected to the second terminal of the driving switch.

For the pixel compensation circuit described above, the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

The pixel compensation method contains the following steps:

in a programming/lighting stage, a second scan line providing a high-level signal so that a third controllable switch, a fourth controllable switch, and a fifth controllable switches are cut off, and a first scan line and the lighting control terminal providing low-level signals so that a driving switch, a first controllable switch, and a second controllable switches are turned on, and an OLED is lighted up; and in an electrical recovery stage, the second scan line providing a low-level signal so that the third, fourth, and fifth controllable switches are turned on, and the first scan line and the lighting control terminal providing high-level signals so that the driving switch, and the first and second controllable switches where, at the moment, the voltage at the control terminal of the driving switch is equal to a voltage output from a voltage terminal, the voltages at a first terminal and a second terminal of the driving switch are equal to a negative reference voltage output from a reference voltage terminal, and the driving switch electrically recovers while the OLED electrically recovers from the negative reference voltage at the first terminal of the driving switch.

For the pixel compensation method described above, the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

The benefit of the present disclosure is as follows. In contrast to the prior art, the pixel compensation circuit and method provide recovery to threshold voltage shift of the driving switch and OLED by employing a number of transistors, thereby achieving uniform brightness on a display panel.

BRIEF DESCRIPTION OF THE DRAWINGS

To make the technical solution of the embodiments according to the present disclosure, a brief description of the drawings that are necessary for the illustration of the embodiments will be given as follows. Apparently, the drawings described below show only example embodiments of the present disclosure and for those having ordinary skills in the art, other drawings may be easily obtained from these drawings without paying any creative effort. In the drawings.

DETAILED DESCRIPTION OF THE PREFERRED EMBODIMENTS

Figure 1:
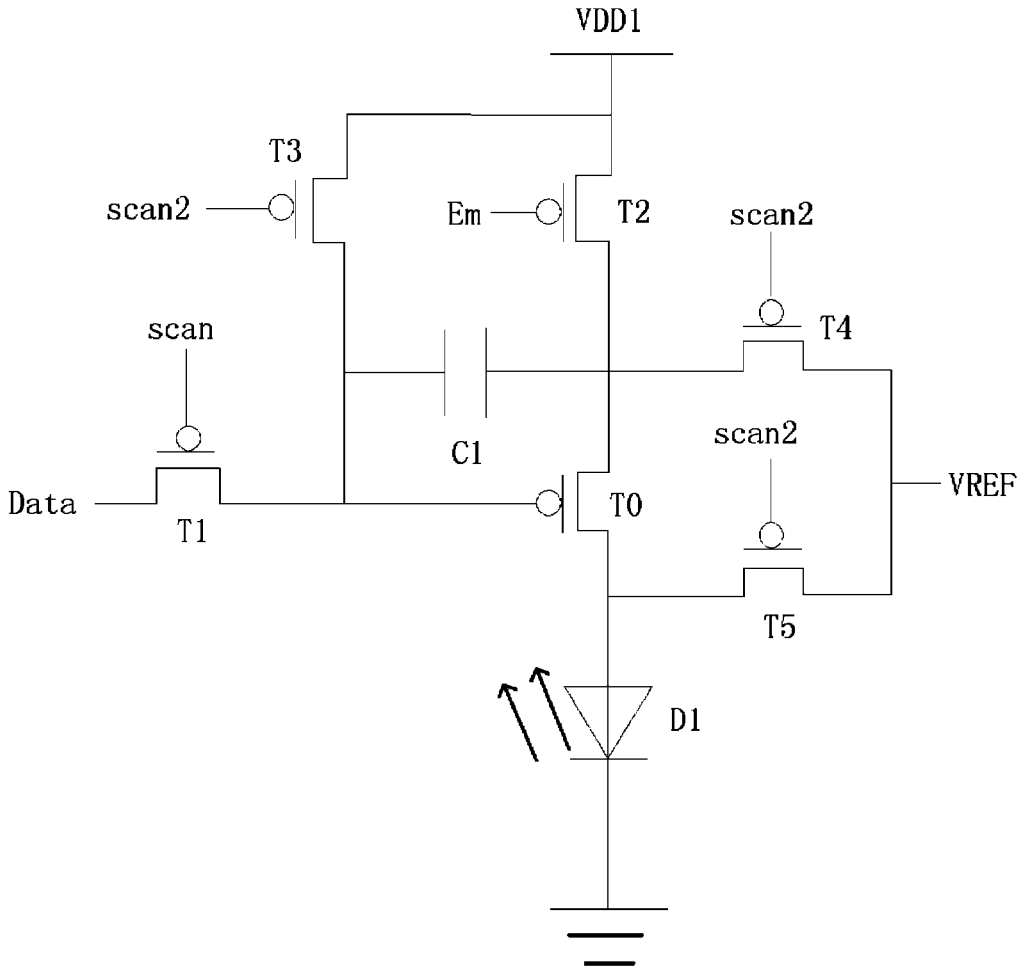
FIG. 1 is a circuit diagram showing a pixel compensation circuit according to a first embodiment of the present disclosure.

FIG. 1 is a circuit diagram showing a pixel compensation circuit according to a first embodiment of the present disclosure. As illustrated, the pixel compensation circuit contains the following components. There is a first controllable switch T1 having a control terminal, a first terminal, and a second terminal. The control terminal is connected to a first scan line (scan). The first terminal is connected to a data line (Data).

There is a driving switch TO having a control terminal, a first terminal, and a second terminal. The control terminal is connected to the second terminal of the first controllable switch T1.

There is an Organic Light Emitting Diode (OLED) D1 having an anode and a cathode. The anode is connected to the second terminal of the driving switch T0, and the cathode is connected to ground.

There is a second controllable switch T2 having a control terminal, a first terminal, and a second terminal. The control terminal is connected to a lighting control terminal Em. The first terminal is connected to a voltage terminal VDD1. The second terminal is connected to the first terminal of the driving switch T0.

There is a third controllable switch T3 having a control terminal, a first terminal, and a second terminal. The control terminal is connected to a second scan line (scan2). The first terminal is connected to the first terminal of the second controllable switch T2. The second terminal is connected to the control terminal of the driving switch T0.

There is a fourth controllable switch T4 having a control terminal, a first terminal, and a second terminal. The control terminal is connected to the second scan line (scan2). The first terminal is connected to the first terminal of the driving switch T0. The second terminal is connected to a reference voltage terminal VREF.

There is a fifth controllable switch T5 having a control terminal, a first terminal, and a second terminal. The control terminal is connected to the second scan line (scan2). The first terminal is connected to the second terminal of the driving switch T0. The second terminal is connected to the reference voltage terminal VREF.

There is a storage capacitor C1 having a first terminal and a second terminal. The first terminal is connected to the control terminal of the driving switch T0. The second terminal is connected to the first terminal of the driving switch T0.

In the present embodiment, the driving switch T0 and the first to the fifth controllable switches T1 to T5 are all P-type metal oxide semiconductor (PMOS), or are all N-type metal oxide semiconductor (NMOS) thin-film transistors, or are a combination of PMOS and NMOS thin-film transistors. The above-mentioned control terminal, first terminal, and second terminal of the driving switch T0 and first to fifth controllable switches T1 to T5 correspond to the gate, drain, and source of thin-film transistors, respectively.

Figure 2:
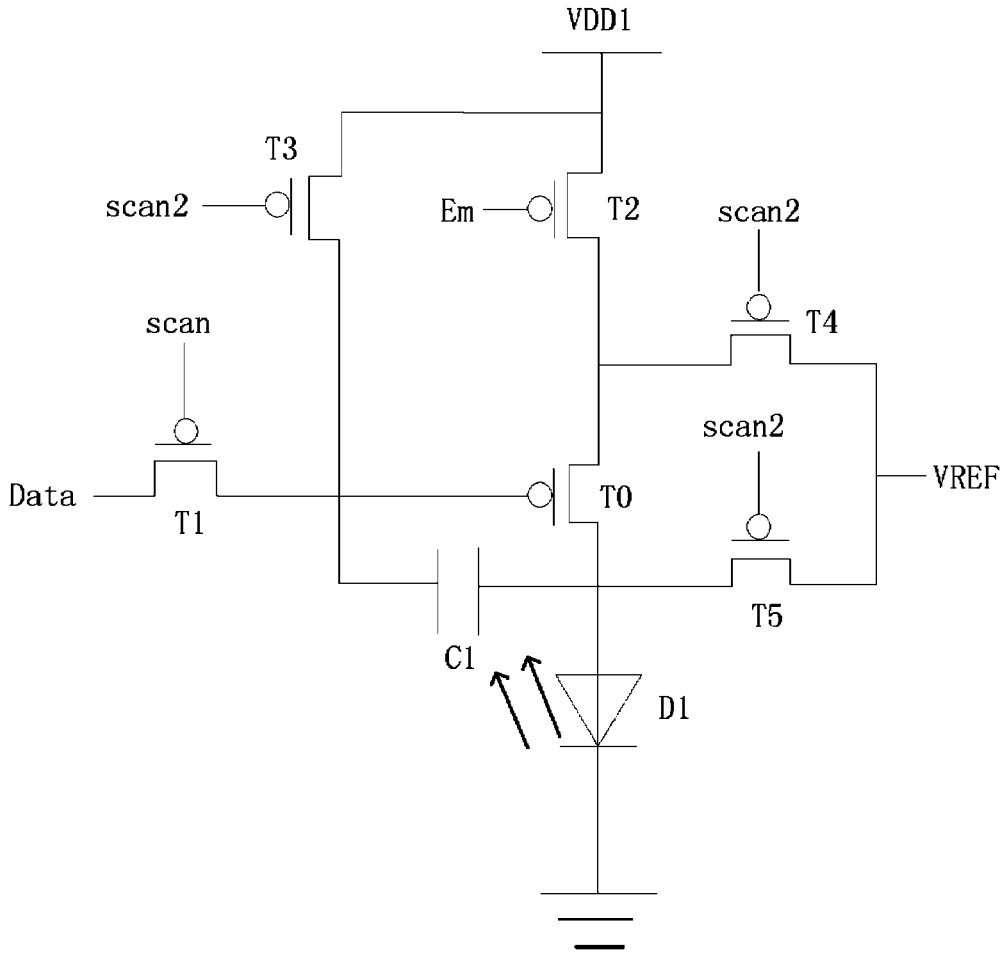
FIG. 2 is a circuit diagram showing a pixel compensation circuit according to a second embodiment of the present disclosure.

FIG. 2 is a circuit diagram showing a pixel compensation circuit according to a second embodiment of the present disclosure. Compared to the previous embodiment, the difference lies in that the storage capacitor C1 of the present embodiment has its first terminal connected to the control terminal of the driving switch T0 and its second terminal connected to the second terminal of the driving switch T0

Figure 3:
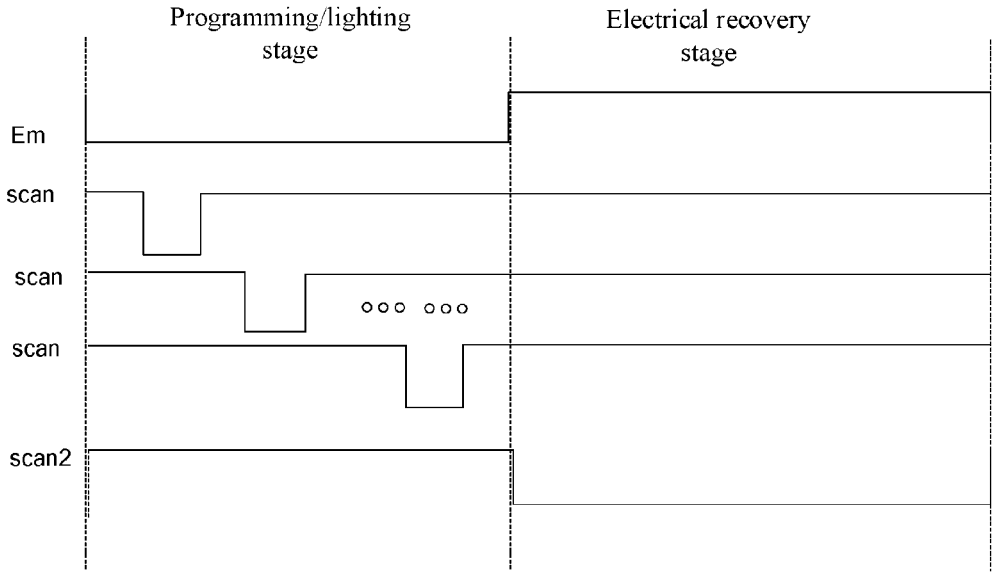
FIG. 3 is a waveform diagram of a pixel compensation circuit according to the present disclosure.

FIG. 3 is a waveform diagram of a pixel compensation circuit according to the present disclosure. Together with FIGS. 1 and 2, the pixel compensation circuit of the present disclosure operates as follows (i.e., a pixel compensation method).

In a programming/lighting stage, the second scan line (scan2) provides a high-level signal. The third, fourth, and fifth controllable switches T3, T4, and T5 are cut off. Low-level signals appear on the first scan line (scan) and the lighting control terminal Em so that the driving switch T0, and the first and second controllable switches T1 and T2 are turned on, and OLED D1 is lighted up.

In an electrical recovery stage, the second scan line (scan2) provides a low-level signal. The third, fourth, and fifth controllable switches T3, T4, and T5 are turned on. The first scan line (scan) and the lighting control terminal Em provide high-level signals so that the driving switch T0, and the first and second controllable switches T1 and T2 are cut off. At the moment, the voltage at the control terminal of the driving switch T0 is equal to a voltage VDD output from the voltage terminal VDD1. The voltages at the first and second terminals of the driving switch T0 are equal to a negative reference voltage Vref output from the reference voltage terminal VREF. The driving switch TO electrically recovers, while OLED D1 also electrically recovers from the negative reference voltage at the first terminal of the driving switch T0. Therefore, the pixel compensation circuit provides recovery to threshold voltage shift, achieving uniform brightness on a display panel.

Figure 4:
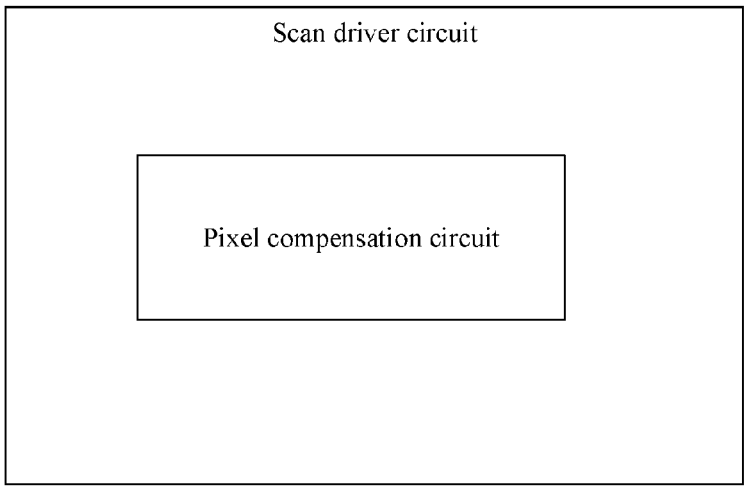
FIG. 4 is a schematic diagram showing a scan driver circuit according to the present disclosure.

FIG. 4 is a schematic diagram showing a scan driver circuit according to the present disclosure. The scan driver circuit contains one of the pixel compensation circuits described above to provide recovery to threshold voltage shift of the scan driver circuit, thereby achieving uniform brightness on a display panel.

Figure 5:
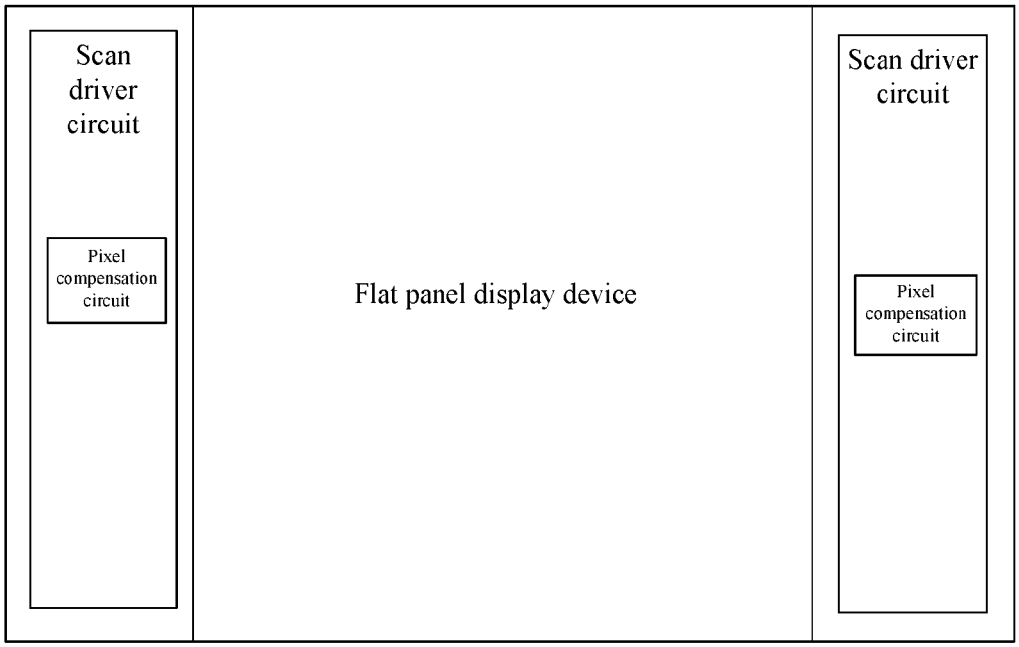
FIG. 5 is a schematic diagram showing a flat panel display device according to the present disclosure.

FIG. 5 is a schematic diagram showing a flat panel display device according to the present disclosure. The flat panel display device can be one based on OLED or a liquid crystal display (LCD) device, containing the above-described scan driver circuit and pixel compensation circuit. The scan driver circuit having the pixel compensation circuit is configured to the flat panel display device's circumference such as along its two lateral sides.

As described above, the pixel compensation circuit and method provide recovery to threshold voltage shift of the driving switch and OLED by employing a number of transistors, thereby achieving uniform brightness on a display panel.

Embodiments of the present disclosure have been described, but not intending to impose any unduly constraint to the appended claims. Any modification of equivalent structure or equivalent process made according to the disclosure and drawings of the present disclosure, or any application thereof, directly or indirectly, to other related fields of technique, is considered encompassed in the scope of protection defined by the clams of the present disclosure.

What is claimed is:

1. A pixel compensation circuit comprising:

a first controllable switch having a control terminal connected to a first scan line, a first terminal connected to a data line, and a second terminal;

a driving switch having a control terminal connected to the second terminal of the first controllable switch, a first terminal, and a second terminal;

an Organic Light Emitting Diode (OLED) having an anode connected to the second terminal of the driving switch and a cathode connected to ground;

a second controllable switch having a control terminal connected to a lighting control terminal, a first terminal connected to a voltage terminal, and a second terminal connected to the first terminal of the driving switch;

a third controllable switch having a control terminal connected to a second scan line, a first terminal connected to the first terminal of the second controllable switch, and a second terminal connected to the control terminal of the driving switch;

a fourth controllable switch having a control terminal connected to the second scan line, a first terminal connected to the first terminal of the driving switch, and a second terminal connected to a reference voltage terminal;

a fifth controllable switch having a control terminal connected to the second scan line, a first terminal connected to the second terminal of the driving switch, and a second terminal connected to the reference voltage terminal; and a storage capacitor having a first terminal connected to the control terminal of the driving switch and a second terminal connected to the first terminal of the driving switch.

2. The pixel compensation circuit as claimed in claim 1, wherein the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

3. A pixel compensation circuit comprising:

a first controllable switch having a control terminal connected to a first scan line, a first terminal connected to a data line, and a second terminal;

a driving switch having a control terminal connected to the second terminal of the first controllable switch, a first terminal, and a second terminal;

an Organic Light Emitting Diode (OLED) having an anode connected to the second terminal of the driving switch and a cathode connected to ground;

a second controllable switch having a control terminal connected to a lighting control terminal, a first terminal connected to a voltage terminal, and a second terminal connected to the first terminal of the driving switch;

a third controllable switch having a control terminal connected to a second scan line, a first terminal connected to the first terminal of the second controllable switch, and a second terminal connected to the control terminal of the driving switch;

a fourth controllable switch having a control terminal connected to the second scan line, a first terminal connected to the first terminal of the driving switch, and a second terminal connected to a reference voltage terminal;

a fifth controllable switch having a control terminal connected to the second scan line, a first terminal connected to the second terminal of the driving switch, and a second terminal connected to the reference voltage terminal; and a storage capacitor having a first terminal connected to the control terminal of the driving switch and a second terminal connected to the second terminal of the driving switch.

4. The pixel compensation circuit as claimed in claim 3, wherein the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

5. A pixel compensation method, comprising the steps of:

in a programming/lighting stage, a second scan line providing a high-level signal so that a third controllable switch, a fourth controllable switch, and a fifth controllable switches are cut off, and a first scan line and the lighting control terminal providing low-level signals so that a driving switch, a first controllable switch, and a second controllable switches are turned on, and an OLED is lighted up; and in an electrical recovery stage, the second scan line providing a low-level signal so that the third, fourth, and fifth controllable switches are turned on, and the first scan line and the lighting control terminal providing high-level signals so that the driving switch, and the first and second controllable switches where, at the moment, the voltage at the control terminal of the driving switch is equal to a voltage output from a voltage terminal, the voltages at a first terminal and a second terminal of the driving switch are equal to a negative reference voltage output from a reference voltage terminal, and the driving switch electrically recovers while the OLED electrically recovers from the negative reference voltage at the first terminal of the driving switch.

6. The pixel compensation method as claimed in claim 5, wherein the driving switch and the first to the fifth controllable switches are P-type metal oxide semiconductor (PMOS) thin-film transistors, N-type metal oxide semiconductor (NMOS) thin-film transistors, or a combination of PMOS and NMOS thin-film transistors; and the control terminal, first terminal, and second terminal of the driving switch and first to fifth controllable switches correspond to the gate, drain, and source of thin-film transistors, respectively.

* * * * *